US008919919B2

(12) United States Patent
Guimerá Predola et al.

(10) Patent No.: US 8,919,919 B2
(45) Date of Patent: Dec. 30, 2014

(54) DEVICE FOR CLEANING AND CLOSING PRINT CARTRIDGES AND CLOSING ELEMENT FOR CLOSING PRINT CARTRIDGES

(71) Applicants: Antoni Guimerá Predola, Barcelona (ES); Francesc Masgrau Lagresa, Barcelona (ES); Antoni Balsells Mercadé, Barcelona (ES)

(72) Inventors: Antoni Guimerá Predola, Barcelona (ES); Francesc Masgrau Lagresa, Barcelona (ES); Antoni Balsells Mercadé, Barcelona (ES)

(73) Assignee: TKT Brainpower, S.L., Barcelona (ES)

( * ) Notice: Subject to any disclaimer, the term of this patent is extended or adjusted under 35 U.S.C. 154(b) by 3 days.

(21) Appl. No.: 13/742,838

(22) Filed: Jan. 16, 2013

(65) Prior Publication Data

US 2013/0182037 A1 Jul. 18, 2013

(30) Foreign Application Priority Data

Jan. 16, 2012 (ES) ..... 201230059

(51) Int. Cl.
*B41J 2/165* (2006.01)

(52) U.S. Cl.
CPC ..... *B41J 2/16505* (2013.01); *B41J 2/165* (2013.01); *B41J 2/16517* (2013.01); *B41J 2/16547* (2013.01)
USPC ..... 347/32; 347/29; 347/22; 347/33; 347/36

(58) Field of Classification Search
CPC . B41J 2/16505; B41J 2/16547; B41J 2/16517
USPC ..... 347/32, 29, 22, 33, 36
See application file for complete search history.

(56) References Cited

U.S. PATENT DOCUMENTS

| | | | | |
|---|---|---|---|---|
| 5,416,507 | A * | 5/1995 | Otsuka | 347/32 |
| 5,585,826 | A | 12/1996 | Schroeder et al. | |
| 5,867,184 | A | 2/1999 | Quintana | |

(Continued)

FOREIGN PATENT DOCUMENTS

| | | |
|---|---|---|
| EP | 0 622 199 | 11/1994 |
| EP | 0 832 746 | 4/1998 |
| EP | 1 024 014 | 8/2000 |
| EP | 1 754 607 | 2/2007 |

OTHER PUBLICATIONS

Spanish Search Report and Written Opinion issued in corresponding Spanish Application No. 201230059 dated Nov. 15, 2013 (with English translation of Written Opinion).

(Continued)

*Primary Examiner* — Henok Legesse
(74) *Attorney, Agent, or Firm* — Ostrolenk Faber LLP

(57) ABSTRACT

The present invention relates to a device characterized in that it comprises a base (3) including a cleaning plate (4), provided with cleaning elements (5), which can be moved along said base (3) and which defines three positions: an injection position which allows the passage of the ink through holes (6) in said base complementary to holes or recesses (7); a cleaning position in which said cleaning elements (5) contact the cartridges (2); and a resting position; and a resting plate (8), provided with closing elements (9), which can be moved along said base (3) by means of the movement of the print head (1) between a position of use of the print cartridges (2) and a resting position in which said closing elements (9) contact the cartridges (2).

14 Claims, 3 Drawing Sheets

(56) References Cited

U.S. PATENT DOCUMENTS

| | | | | |
|---|---|---|---|---|
| 5,870,115 | A | 2/1999 | Kikuchi et al. | |
| 5,883,647 | A * | 3/1999 | Uchida | 347/29 |
| 5,917,516 | A | 6/1999 | Nguyen et al. | |
| 6,585,347 | B1 | 7/2003 | Johnson et al. | |
| 6,926,383 | B2 * | 8/2005 | Chang | 347/32 |
| 7,275,802 | B2 * | 10/2007 | Berardelli et al. | 347/22 |
| 2004/0189736 | A1 * | 9/2004 | Maher | 347/22 |
| 2004/0252154 | A1 | 12/2004 | Griesemer et al. | |
| 2006/0197798 | A1 | 9/2006 | Hsu | |
| 2011/0043568 | A1 * | 2/2011 | Heo et al. | 347/33 |
| 2011/0148982 | A1 | 6/2011 | Katoh et al. | |

OTHER PUBLICATIONS

Extended European Search Report issued in corresponding European Application No. 13151421.8 dated Apr. 23, 2013.

* cited by examiner

DEVICE FOR CLEANING AND CLOSING PRINT CARTRIDGES AND CLOSING ELEMENT FOR CLOSING PRINT CARTRIDGES

The present invention relates to a device for cleaning and closing print cartridges and to a closing element for closing print cartridges, particularly applicable for a plotter.

BACKGROUND OF THE INVENTION

Plotters and inkjet printers comprise print cartridges. Ink can be discharged through said print cartridges on paper for printing whatever desired.

When not printing, the cartridges are usually located in a resting position, such that there is an easy access, for example, for changing the ink cartridges. If printing is not performed for a long period of time, the placement of these cartridges in the resting position has the drawback that they are exposed to dust and air, which can adversely affect the subsequent print quality.

Furthermore, there is usually a need to perform a periodic cleaning operation to clean the cartridges, such that said cartridges go through cleaning elements whenever the user decides same. However, in practice said cleaning operations are usually not performed regularly enough, which can also adversely affect the print quality.

On the other hand, there are systems for cleaning and closing the print cartridges in inkjet printers, they are however very complex and expensive.

Therefore, there is a need for a device which allows assuring the print quality at all times, even in the event that printing has not been performed for a long period of time or that the user has not conducted any cleaning operation.

DESCRIPTION OF THE INVENTION

The mentioned drawbacks are solved with the device and the element of the invention, having other advantages which will be described below.

The device for cleaning and closing print cartridges of the present invention, in which said print cartridges are placed in a movable print head, is characterized in that it comprises a base including:

- a cleaning plate, provided with a plurality of cleaning elements, which can be moved along said base by means of the movement of the print head and which defines three positions: an injection position which allows the passage of the ink through holes in said base complementary to holes or recesses in said cleaning plate; a cleaning position in which said cleaning elements contact the print cartridges; and a resting position; and
- a resting plate, provided with a plurality of closing elements, which can be moved along said base by means of the movement of said cleaning plate between a position of use of the print cartridges and a resting position, in which said closing elements contact the print cartridges.

Said base preferably comprises first guides for guiding said cleaning plate, comprising an oblique segment and a longitudinal segment, pins of said cleaning plate sliding therein, and also comprises second guides for guiding said resting plate, comprising a ramp, pins of said resting plate sliding therein, such that in said resting position the resting plate is in a higher position with respect to the base than in the position of use.

According to a preferred embodiment, said cleaning plate comprises a protrusion. Said protrusion contains a ferromagnetic element complementary to a magnet located in said print head.

Advantageously, said print head comprises a magnet in the area of contact with said protrusion of said resting plate.

Advantageously, said print head comprises a transverse guide, housing therein said protrusion of said cleaning plate when said print head pushes against said cleaning plate.

When said head moves from the injection position to the resting position, said transverse guide pushes the protrusion of said cleaning plate, causing a diagonal forward movement of said cleaning plate. Said movement of said cleaning plate is a transverse movement with respect to the head, allowing the cleaning elements to perform their function of cleaning from bottom to top.

When said head moves from the resting position to the injection position, said transverse guide pushes the protrusion of said cleaning plate, causing a diagonal return movement of said cleaning plate to the injection position. Said movement of said cleaning plate is a transverse movement with respect to the head, allowing the cleaning elements to perform their function of cleaning from top to bottom.

Said cleaning plate comprises a ferromagnetic element complementary to a magnet located in said base, such that said elements allow keeping said cleaning plate in said injection position.

When said head moves from the injection position to the resting position, said head contacts said protrusion of said resting plate and pushes it, causing a forward movement. As a result of said guides of said base, the forward movement is converted into a forward and upward movement. Said upward movement allows the closing elements to perform their function in the resting area.

When said head moves from the resting position to the injection position, said magnet located in said head exerts an attractive force on said ferromagnetic element located in said protrusion of said resting plate assuring the return movement of said resting plate to the injection position. As a result of said guides of said base, the return movement is converted into a return and downward movement. Said downward movement allows the closing elements to stop contacting the print cartridges, ending the function of closing.

Advantageously, each of said closing elements are attached to the resting plate by means of a pair of flexible arms, such that when said resting plate is in its resting position, said arms deform and the closing element is moved in a manner substantially parallel with respect to its preceding position, being coupled to the closing plane of each cartridge, individually absorbing the imperfections thereof for an optimum closure in a print cartridge.

According to a preferred embodiment, said cleaning elements are flexible vertical protrusions.

According to a second aspect, the closing element for closing print cartridges comprises a closing body for coupling with a print cartridge, and is characterized in that said closing body is attached to a plate by means of a pair of elastic arms, such that when said closing body and a print cartridge contact one another, the closing body is moved such that it is coupled to the plane of the print base of the print cartridge.

According to a preferred embodiment, said elastic arms are attached to the closing body at its furthest end with respect to said plate, although depending on the shape of each arm, they could be attached to the plate in another position.

According to a preferred embodiment, each elastic arm has a width decreasing, for example in three segments, from its end attached to the plate to its end furthest from said plate.

Said closing body preferably comprises a rubber gasket for the leak-tight closure of the print cartridge.

The device and the element of the present invention have the following advantages:

- the print quality is maintained at all time, since the cartridges are always placed in its resting position clean (as a result of the action of the cleaning elements of the cleaning plate) and hermetically closed (as a result of the closing elements of the resting plate);
- all the movements of said cleaning and resting plates are performed in a completely mechanical manner by means of placing guides and magnets, such that the cost and maintenance thereof are reduced;
- the closing elements are fixed to the resting plate by means of flexible arms allowing a hermetic closure of the print cartridges as a result of the substantially parallel movement thereof which can be adapted to the closing plane with respect to the initial position thereof;
- all the functionalities described above are combined in a single element: the base with its cleaning and resting plates, such that it is easy to replace, maintain and clean same.
- all the functionalities described above: position, forward movement, halt, etc., are controlled by the same motor, which allows the forward movement of the print head or heads, such that it is a very easy to adjust system, therefore not requiring any additional mechanism or sensor for adjustment and operation.

BRIEF DESCRIPTION OF THE DRAWINGS

To better understand what has been set forth above, drawings in which a practical embodiment is schematically depicted only by way of non-limiting example are attached.

DESCRIPTION OF A PREFERRED EMBODIMENT

Figure 1:
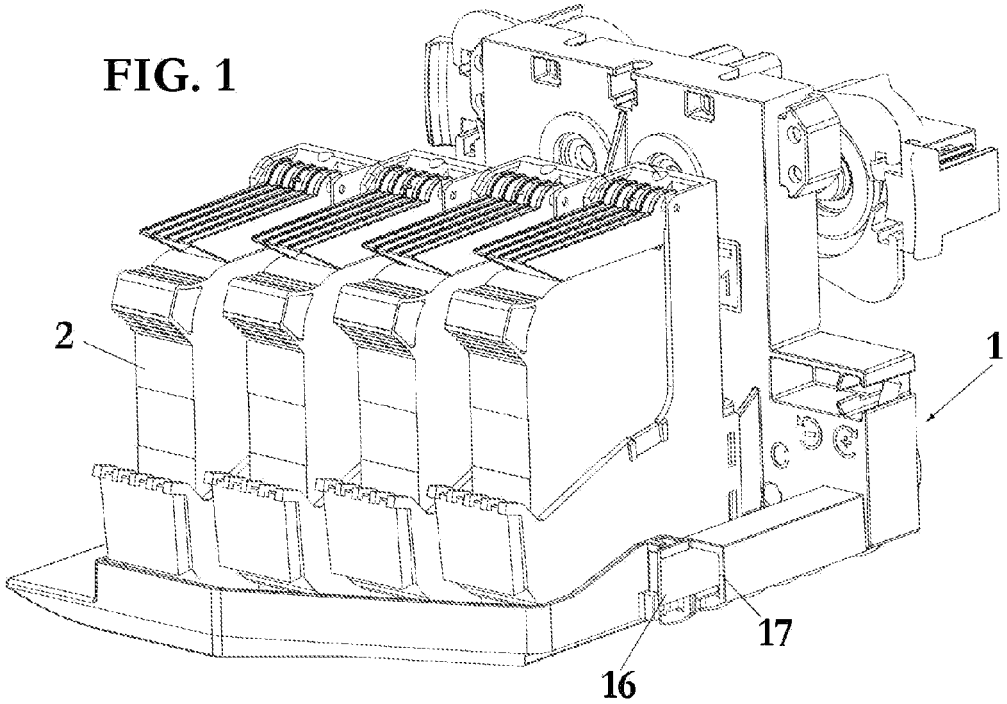
FIG. 1 is a perspective view of the print head of the device of the present invention.

First, it must be indicated that the device of the present invention is particularly designed for use with a plotter.

As in any conventional plotter, there is a print head 1 which is moved for printing. Said print head 1, depicted in FIG. 1, comprises a plurality of print cartridges 2 having printing ink.

A base 3 comprising a cleaning plate 4 and a resting plate 8 which will be described below is arranged on one side of the path of said print head 1.

The base 3 comprises first grooves 11 and second grooves 13 to allow the movement of said cleaning plate 4 and resting plate 8, respectively.

The cleaning plate 4 comprises a plurality of cleaning elements 5, which preferably are flexible protrusions 5.

Figure 3:
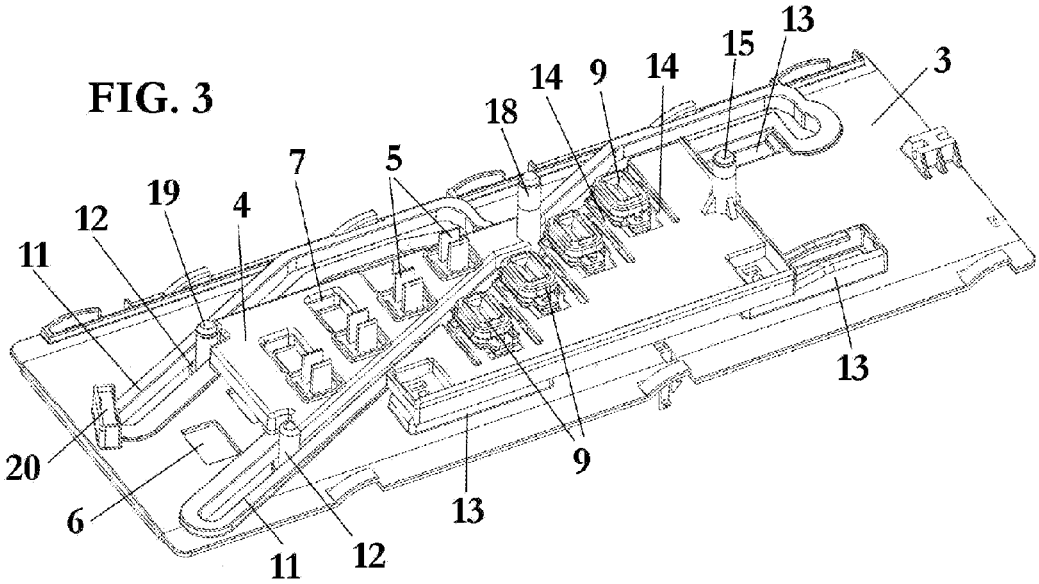
FIG. 3 is a perspective view of the base of the device of the present invention with the cleaning plate in its cleaning position and the resting plate in the position of use of the print cartridges.
Figure 4:
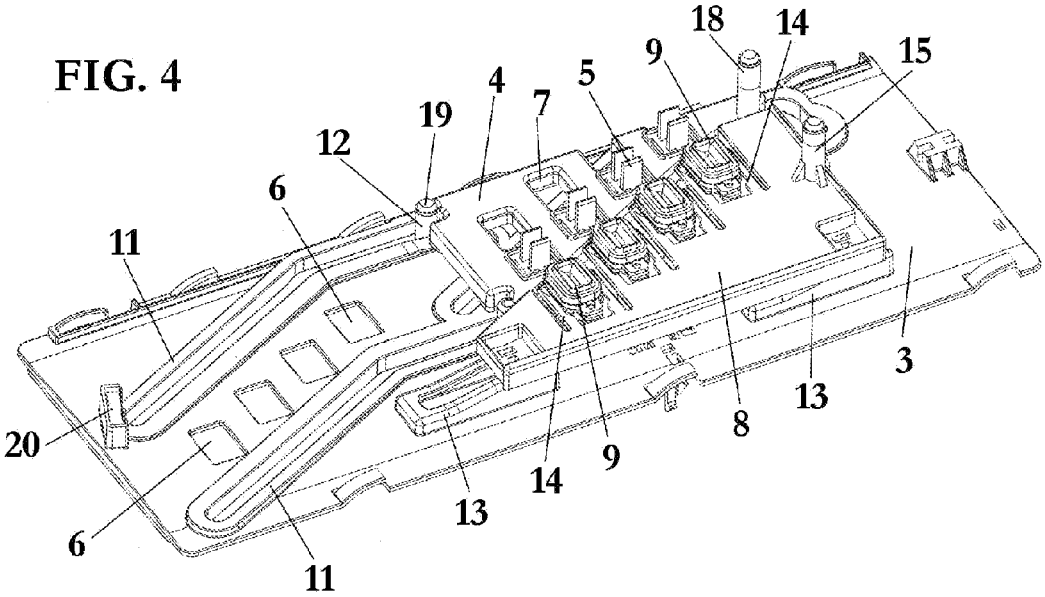
FIG. 4 is a perspective view of the base of the device of the present invention with the cleaning plate and the resting plate in their respective resting positions.

Said cleaning plate 4 can be placed in three different positions:

- an injection position (depicted in FIG. 2) in which holes and recesses 7 in said cleaning plate 4 match the holes 6 of said base 3, allowing the ink of the cartridges 2 to pass through said holes 6 and 7;
- a cleaning position (depicted in FIG. 3) in which said cleaning elements 5 contact the cartridges 2, cleaning them; and
- a resting position in which the plotter is not used (depicted in FIG. 4).

The resting plate 8 in turn comprises a plurality of closing elements 9, one for each cartridge 2. Each of these closing elements 9 comprises a closing body 21 which is attached to the resting plate 8 by means of a pair of flexible arms 14, such that when they are coupled to said cartridges 2, the closing elements 9 are moved substantially parallel with respect to their original position and it in turn allows adapting to the individual closing plane compensating the imperfections thereof as a result of the elastic deformation of said arms 14.

Specifically, when the closing body 21 contacts the print cartridge 2, the flexible arms 14 suitably deform in any angle, since they can move in any direction. The closing body 21 thus fully contacts the print base (an area to be printed on) of the cartridge 2, allowing a leak-tight closure.

Figure 5:
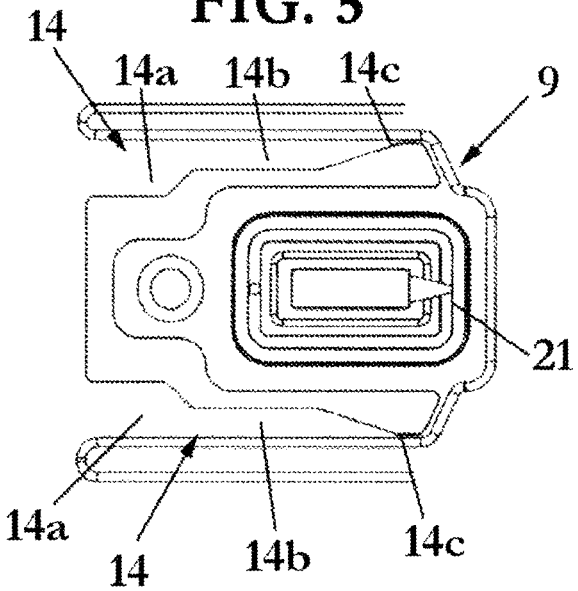
FIG. 5 is a plan view of a closing element for closing print cartridges according to the present invention.

As can be seen in more detail in FIG. 5, said elastic arms 14 are attached to the closing body 21 at its furthest end with respect to said plate 8, although depending on the shape of each arm, they could be attached to the plate in another position.

According to a preferred embodiment, each elastic arm 14 comprises three segments 14*a*, 14*b*, 14*c* with a width decreasing from its end attached to the plate 8 to its end furthest from said plate 8, to achieve the desired effect of elastic deformation. However, it must be indicated that the elastic arms 14 do not necessarily comprise three segments, rather what is important is that the width is decreasing.

Furthermore, said closing body 21 comprises a rubber gasket for assuring the leak-tight closure of the print cartridge 2.

Said resting plate 8 can be placed in two different positions:

- a position of use of the cartridges (depicted in FIGS. 2 and 3); and
- a resting position in which the plotter is not used (depicted in FIG. 4).

Figure 2:
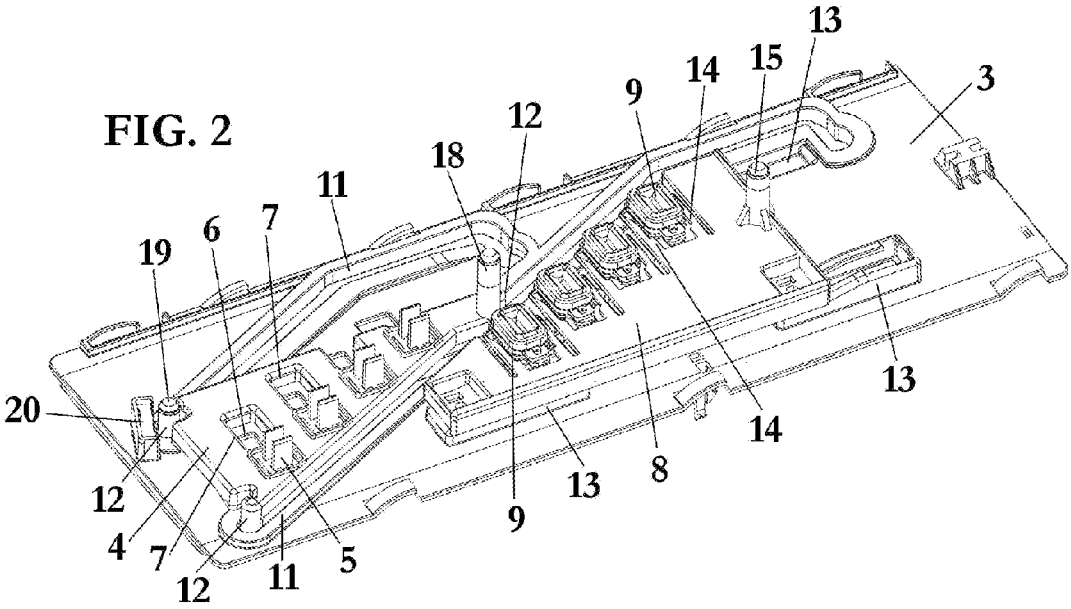
FIG. 2 is a perspective view of the base of the device of the present invention with the cleaning plate in its injection position and the resting plate in the position of use of the print cartridges.

The operation of the device of the present invention is as follows:

When the print head 1 reaches said base 3 on the left of FIGS. 2 to 4, said print head 1 is coupled on said cleaning plate 4.

It must be indicated that, in order to be able to clearly see the movement of the cleaning plate 4 and resting plate 8, the print head 1 has not been depicted in FIGS. 2 to 4.

In this position, a protrusion 18 provided in said cleaning plate 4 is coupled with a transverse groove 17 which can be seen in FIG. 1.

When the print head 1 continues moving to the right, according to FIGS. 2 to 4, said protrusion 18 moves through said transverse groove 17 and said cleaning plate 4 moves to its cleaning position. This movement is performed as a result of pins 12 of the cleaning plate 4 which are housed inside the first grooves 11 of the base 3.

In the cleaning position, the cleaning elements 5 clean the cartridges 2, and the print head 1 continues moving to the right, as shown in FIGS. 2 to 4.

When the print head 1 continues moving, the cleaning plate 4 will also continue moving as a result of the protrusion 18 housed in said transverse groove 17. Said resting plate 8 will move at the same time since said head 1 contacts said protrusion 15 of said resting plate 8 and pushes it.

Said resting plate 8 slides along said second grooves 13 provided in the base 3. Said second grooves 13 comprise a ramp, such that in the resting position, said resting plate 8 is in a higher position with respect to said base 3 than in the position of use.

After performing this movement, the closing elements 9 are coupled with the cartridges 2, hermetically closing them to keep the ink intact until subsequent use.

Said hermetic closure is achieved as a result of the flexible arms 14 connecting the closing elements 9 with the resting plate 8, such that a substantially parallel movement of said closing elements 9 between their resting position and their closing position against the cartridges 2 is achieved.

In this resting position, the cartridges 2 are clean and hermetically closed, ready for use anytime the user desires same.

When the plotter is again operated, the print head 1 moves from right to left, according to the drawings of FIGS. 2 to 4, the movement opposite that described above being performed.

In said movement, for the resting plate 8 to also move with the print head 1, a ferromagnetic element 15 which is complementary to a magnet 16 placed in the print head 1 is provided in a protrusion of said resting plate 8. The magnetic force between these two elements 15, 16 will cause the movement of said resting plate 8 from its resting position to its position of use, causing the closing elements 9 to be removed from the cartridges 2 at the same time.

It must be indicated that said cleaning plate also comprises a ferromagnetic element 19 complementary to a magnet 20 located in said base, such that said magnets allow keeping said cleaning plate in said injection position.

Although reference has been made to a specific embodiment of the invention, it is obvious for a person skilled in the art that the described device is susceptible to numerous variations and modifications, and that all the mentioned details can be replaced with other technically equivalent details, without departing from the scope of protection defined by the attached claims.

The invention claimed is:

1. Device for cleaning and closing print cartridges, wherein said print cartridges are placed in a movable print head comprising:

a base including:

a cleaning plate, provided with a plurality of cleaning elements, which is configured to move relative to said base by the print head and which defines three positions:

an injection position which allows the passage of the ink through holes in said base for printing, complementary to holes or recesses in said cleaning plate;

a cleaning position in which said cleaning elements contact the print cartridges; and a cleaning plate resting position; and a resting plate, provided with a plurality of closing elements, which is configured to move relative to said base independent of said cleaning plate by said print head between a use position in which said closing elements do not have contact with the print cartridges and a resting plate resting position, in which said closing elements contact the print cartridges.

2. Device according to claim 1, wherein said base comprises first guides for guiding said cleaning plate, comprising an oblique segment and a longitudinal segment, pins of said cleaning plate sliding therein.

3. Device according to claim 1, wherein said base comprises second guides for guiding said resting plate, comprising a ramp, pins of said resting plate sliding therein, such that in said resting position the resting plate is in a higher position with respect to the base than in the position of use.

4. Device according to claim 1, wherein each of said closing elements are attached to the resting plate by means of a pair of flexible arms, such that when said resting plate is in its resting position, said arms deform and the closing element is moved such that it is coupled to the plane of the print base of a print cartridge.

5. Device according to claim 1, wherein said resting plate comprises a ferromagnetic element complementary to a magnet located in said print head, such that said ferromagnetic element and said magnet allow the resting plate to return from said resting position to said use position by means of the movement of said print head.

6. Device according to claim 5, wherein said ferromagnetic element of the resting plate is located in the upper part of a protrusion.

7. Device according to claim 1, wherein said cleaning plate comprises a ferromagnetic element complementary to a magnet located in said base, such that said magnets allow keeping said cleaning plate in said injection position.

8. Device according to claim 1, wherein said print head comprises a transverse guide, housing therein a protrusion of said cleaning plate when said print head pushes against said cleaning plate.

9. Device according to claim 1, wherein said cleaning elements are flexible vertical protrusions.

10. Device according to claim 1, wherein at least one of said closing elements comprises a closing body for coupling with one of said print cartridges wherein said closing body is attached to a plate by means of a pair of elastic arms, such that when said closing body and said one of said print cartridges contact one another, the closing body is moved such that it is coupled to a plane defined by a print base of the print cartridge.

11. Device according to claim 10, wherein said elastic arms are attached to the closing body at its furthest end with respect to said plate.

12. Device according to claim 10, wherein each elastic arm has a width decreasing from its end attached to the plate to its end furthest from said plate.

13. Device according to claim 12, wherein each elastic arm comprises three segments with a width decreasing from its end attached to the plate to its end furthest from said plate.

14. Device according to claim 10, wherein said closing body comprises a rubber gasket for the leak-tight closure of the print cartridge.

* * * * *